US009149118B2

(12) United States Patent
Schneider

(10) Patent No.: US 9,149,118 B2
(45) Date of Patent: Oct. 6, 2015

(54) DEVICE AND SYSTEM FOR CONTROLLING THE MOVEMENT OF A FURNITURE PART, MOUNTING FIXTURE FOR SAID DEVICE AND PIECE OF FURNITURE

(75) Inventor: Klaus Schneider, Höchst (AT)

(73) Assignee: Grass GmbH, Hochst (AT)

( * ) Notice: Subject to any disclaimer, the term of this patent is extended or adjusted under 35 U.S.C. 154(b) by 1216 days.

(21) Appl. No.: 12/608,396

(22) Filed: Oct. 29, 2009

(65) Prior Publication Data

US 2010/0090570 A1 Apr. 15, 2010

Related U.S. Application Data

(63) Continuation of application No. PCT/EP2008/003512, filed on Apr. 30, 2008.

(30) Foreign Application Priority Data

Apr. 30, 2007 (DE) ..... 20 2007 006 300

(51) Int. Cl.
*A47B 88/04* (2006.01)

(52) U.S. Cl.
CPC ..... *A47B 88/0477* (2013.01)

(58) Field of Classification Search
CPC ..... A47B 88/0477
USPC ..... 312/330.1, 334.1, 334.4, 334.5, 334.7, 312/319.1, 319.2, 319.5; 384/20, 22
See application file for complete search history.

(56) References Cited

U.S. PATENT DOCUMENTS

| | | | | |
|---|---|---|---|---|
| 1,334,712 | A * | 3/1920 | Olson | 312/234.1 |
| 6,457,791 | B1 | 10/2002 | Müterthies et al. | |
| 2007/0145867 | A1 | 6/2007 | Gasser | |
| 2007/0180654 | A1 | 8/2007 | Gasser | |

FOREIGN PATENT DOCUMENTS

| | | | |
|---|---|---|---|
| DE | 1778452 | * | 10/1971 |
| DE | 33 15 254 | A1 | 11/1983 |
| DE | 198 42 666 | A1 | 9/1999 |
| DE | 199 44 642 | A1 | 3/2001 |
| DE | 20 2004 001 068 | U1 | 4/2004 |
| DE | 20 2004 016 211 | U1 | 1/2005 |
| DE | 20 2004 019 689 | U1 | 3/2005 |
| WO | 2006/017864 | A1 | 2/2006 |
| WO | 2006/017865 | A1 | 2/2006 |

* cited by examiner

*Primary Examiner* — James O Hansen
(74) *Attorney, Agent, or Firm* — Burr & Brown, PLLC

(57) ABSTRACT

A mounting fixture for attaching at least one device for controlling the movement of a furniture part which is received on a stationary furniture part so as to be movable in a driven manner. According to the invention, a fastening mechanism is provided, with elongate profiles which extend separately from each other with a clearance in between them and to which the device for controlling the movement can be attached.

18 Claims, 7 Drawing Sheets

DEVICE AND SYSTEM FOR CONTROLLING THE MOVEMENT OF A FURNITURE PART, MOUNTING FIXTURE FOR SAID DEVICE AND PIECE OF FURNITURE

CROSS REFERENCE TO RELATED APPLICATIONS

This application is a continuation of International Application No. PCT/EP2008/003512 filed Apr. 30, 2008, which designated the United States, and claims the benefit under 35 USC §119(a)-(d) of German Application No. 20 2007 006 300.8 filed Apr. 30, 2007, the entireties of which are incorporated herein by reference.

FIELD OF THE INVENTION

The invention relates to a mounting fixture, a device, a system and a piece of furniture.

BACKGROUND OF THE INVENTION

Arrangements for mounting or for attaching a device for controlling the movement of a furniture part are known in the furniture sector. In modern pieces of furniture, in addition to aesthetic aspects, ease of use of the pieces of furniture is becoming increasingly important. For this purpose, use may be made, for controlling the movement of a furniture part, of a broad range of devices, for example devices which assist in a driven manner opening or closing or which dampen the movement into an end position. In this way, the user of the piece of furniture can be provided with helpful additional functions on the piece of furniture. In order to find high acceptance in practice, as little space as possible must be required for accommodating the device for controlling the movement. Furthermore, the solution should be inexpensive and mounting should be easily possible.

SUMMARY OF THE INVENTION

The object of the invention is to provide a device or fixture of the above-mentioned type or a corresponding system and a piece of furniture which is accordingly equipped, wherein requirements with regard to financial and technical considerations can be fulfilled more effectively compared to previous solutions.

The invention starts in the first place from a mounting fixture for attaching a device for controlling the movement of a furniture part which is received on a stationary furniture part so as to be movable in a driven manner. One aspect consists in the fact that a fastening mechanism is provided, with elongate profiles which extend separately from each other with a clearance in between them and to which the device for controlling the movement can be attached. Various advantages in a financial or technical regard may be achieved in this way. Firstly, the mounting fixture can be purposefully adapted to allow stable and flexibly employable attachment of the device. Furthermore, the mounting fixture itself can be configured on a piece of furniture in an extremely compact manner, even the accommodation of the device for controlling the movement on the mounting fixture requiring just comparatively very little additional overall space. Compact packaging for transportation prior to fitting into the piece of furniture is also possible. Overall, according to the invention, the useful space provided with a piece of furniture is reduced only insignificantly by the mounting fixture or by the device attached thereto for controlling the movement. In addition, with elongate profiles which can be formed with low weight or require little material to be used, dimensions present in the piece of furniture or a furniture part can be overcome in all cases; this is often helpful for reasons of stable fastening. This allows the mounting fixture itself to be attached with comparatively few difficulties or if appropriate to different attachment points in various types of furniture.

An important advantage may also be identified in the fact that the mounting fixture, with the profiles extending separately from each other with a clearance in between them, combines maximum usability with minimum complexity. The term "clearance" may be understood, in accordance with a clear width, for example as the free space between uprights of a bridge or opposing door frames. A clearance is formed by a free space between the profiles, in particular while providing a material-free intermediate region of the profiles. The clearance is present in particular over relevant dimensions along the profiles, if appropriate over their entire or almost entire length. The clearance can be used to form, in particular, a free passage, extending up to the profiles themselves, transversely to the longitudinal extension of the profiles. The clearance or the material-free region between the profiles can also be singly or multiply interrupted over the length of the profiles, in particular via a small number of interruptions, which are narrow relative to the length of the profiles, of the clearance.

Advantageously, two elongate profiles may be present, which are connected to each other if appropriate merely at one point, for example in their central region or in the region halfway along their length, by a, for example, spacer element. The spacer element may be securely attachable to one or to both or a plurality of profiles or it may be releasably attachable to a profile. The mounting fixture can also comprise profiles which generate a plurality of clearances. On both sides of the spacer element, the clearance may be formed so as to be completely continuous. In addition, the clearance may be formed via the profiles so as to be constant or to differ in size. In a particularly simple embodiment, the elongate profiles can at their end regions each be fixed or fastened, if appropriate connected to one another.

In order to increase stability, for example in the case of very heavy movable furniture parts, more than two elongate profiles are also possible.

Advantageously, the profiles are embodied in such a way that the device for controlling the movement can be fixed to the profiles at one of a plurality of possible points. For example, the entire length of the profiles, in particular in the region of the clearance, can be variably utilized for attaching the device for controlling the movement. In this way, it is possible to find, depending on the configuration of the furniture part in question or of the piece of furniture, different ideal attachment positions for the device for controlling the movement. This is also advantageous in particular for mounting reasons. Thus, the mounting or dismounting of the device for controlling the movement may be carried out without difficulty more rapidly or else by a person who is inexperienced with regard to mounting operations.

It is further possible that the profiles extend substantially parallel and be received at their ends in flange parts. It is thus possible to achieve end-side stable attachment of the profiles without taking up spaces formed by the clearance or reducing the corresponding free spaces. Also, especially simple and reproducible attachment of the device for controlling the movement of a furniture part is possible on profiles extending substantially parallel. In particular, a given intermediate distance of the profiles or the clearance can remain constant over the entire length of the profiles, allowing the movement controlling device to be attached over the entire extension of the profiles using an attachment mechanism which is adapted to this constant parallel distance. The flange parts can be embodied as separate components or integrally on a profile, for example with both ends of a profile. For example, the flange parts can be secured to portions of the piece of furniture. In principle, it is also possible for the profiles to be received on the furniture part or in the piece of furniture not in flange parts, but on portions provided therefor. For example, depressions which are present in walls of the furniture parts or the piece of furniture may be provided here. Clamping-in or adhesive bonding of a profile to furniture parts is also possible.

It is particularly advantageous for the flange parts to consist of flat wall portions on which receptacles are embodied for releasably attaching the ends of the profiles, in particular for clipping-in the ends of the profiles. This allows the flange parts to be embodied in a very compact but at the same time mechanically stable manner, in particular in order to be able to be fixed to flat wall portions of a furniture part or to be supported thereon in a planar manner via the wall portions of the flange parts on mating portions of the furniture part. For this purpose, the flange parts can for example be screwed on, pegged on, adhesively bonded on, soldered on or fixed in a different manner to the furniture part. As a result of the flat wall portions, the flange parts take up only a comparatively small space transversely to the planar extension of the wall portions. It is also advantageous for the flange parts to allow releasable attachment of the ends of the profiles. For mounting and dismounting, the profiles can then be simply clipped on and re-removed.

In addition to clipping-in of the ends of the profiles, other releasable attachment mechanisms are also particularly suitable; releasable attachments which can be applied without additional measures or without the use of tools are particularly preferred. For example, a bayonet closure or a magnetically acting attachment mechanism can be used here. The profile ends can also be fastened, for example, using a fixing screw which presses against an outside of the profile as a result of being screwed into a tapped hole on the flange part.

It is also possible that the longitudinal axes of the profiles, which jointly allow the attachment of a device for controlling the movement, extend either substantially parallel horizontally or substantially parallel vertically. This allows the profiles to be utilized at different points on the furniture part over an entire height or width of the piece of furniture.

In principle, it is also advantageous for the longitudinal axes of the profiles, which jointly allow the attachment of a device for controlling the movement, to intersect. In the region of an intersection, the profiles can for example be connected to one another; the term "intersecting of the profiles" may also be taken to mean guiding-past in a nearby region without contact of the profiles in question. The intersecting profiles can provide, at least over regions of intersection, a clearance of the profiles relative to one another that may be utilized for attaching a device for controlling the movement. In this way, the device for controlling the movement can be fastened, for example, to a vertically and to a horizontally extending profile. This might be advantageous for reasons of space or for reasons of stable attachment of the device for controlling the movement to the profiles.

Preferably, the profiles are embodied in an electrically conductive manner for supplying electricity to the device attached thereto for controlling the movement. In particular, automatic contacting can be carried out via corresponding connecting points formed on an attachment mechanism for attaching the device for controlling the movement to the profiles. The profiles can be utilized for supplying power, thus eliminating the need for, in particular, cable arrangements. The electrifiable profiles can be used, as an alternative to the synchronous ejection of two or more units which are attached to the same mounting device, as a signal line. With more than two profiles or with electronic components, for example for modulating the synchronization signal to the supply voltage, even only with two profiles, a combination of the power supply function and the signal line function is also possible for synchronously ejecting the two or more units.

Finally, it is possible that the profiles and/or the ejection lever be embodied to allow an adjustment of a closing gap. In the closing position of the movable furniture part, the closing gap between a front side of the movable furniture part and a front portion of the stationary furniture part can be altered in a defined manner via a spatial adjustment, in particular of one of the profiles and/or of the ejection lever, for example if the ejection lever can be fixed at a different spread angle in two parts in the manner of a spreadable circle.

The invention also relates to a device for controlling the movement of a furniture part which is received on a stationary furniture part so as to be movable in a driven manner. A key aspect of the invention consists in this case in the fact that the device has an attachment mechanism for attaching to a mounting fixture, the mounting fixture being embodied as described above. Thus, the device for controlling the movement can be securely fixed to the mounting fixture according to the invention via the attachment mechanism. The above-mentioned advantages allow the device for controlling the movement of a furniture part also to be advantageously used.

It is further possible that the attachment mechanism be configured in such a way that the device for controlling the movement can be clipped onto the mounting fixture. Clipping the device for controlling the movement onto the mounting fixture allows straightforward or rapid attachment or re-removal of the device for controlling the movement. In particular, this can be carried out without a tool. Readjustment or precise positioning of the device for controlling the movement in an ideal position transversely to the clipping-in direction may also easily be possible as a result.

It is moreover preferable for the device for controlling the movement to comprise a basic element which can be attached to the mounting fixture via a attachment mechanism which is present thereon on the edge side. In particular, the device for controlling the movement can be releasably attached to the profiles or re-removed by hand. It is particularly advantageous if the attachment mechanism is embodied in such a way that the device for controlling the movement can be accommodated, when attached, in the free intermediate space, or the intermediate space provided by the clearance, between the profiles. Thus, the basic element, which forms all or most of the device for controlling the movement, can be lowered, as it were, while filling out the profile intermediate space between the profiles.

In an additionally advantageous embodiment of the invention, the attachment mechanism has portions which hinder displacement of the basic element, which is clipped onto the profiles, along the profiles. For example, portions of the attachment mechanism that, when clipped-on, enter into abutting contact with the profiles can be made of, for example, soft or rubber-like or foam-like material. Such portions can prevent or substantially prevent, by increasing the frictional adhesion to the profiles, displacement of the basic element.

Furthermore, the invention relates to a system for controlling the movement of a furniture part, the system consisting of a mounting fixture as described above and of a device for controlling the movement as described above. This can provide a system, the system elements of which are ideally adapted to one another, wherein both the mounting fixture and the device for controlling the movement may be used in a compact or financially and technically advantageously mutually adapted manner, in particular for use in a piece of furniture.

Advantageously, the overall size of the device for controlling the movement is adapted in such a way that a basic element of the device for controlling the movement extends, when attached to the mounting fixture, substantially between the profiles extending with a clearance in between them. In this way, it is possible to produce a minimum necessary overall space for accommodating the device for controlling the movement, including the profiles.

The device for controlling the movement is fastened, in the case of a piece of furniture with a drawer, most simply and securely to the surfaces in proximity to the fastening of a drawer guide. For example, in this case, a right body side is connected to the left body side via the profiles or via crossmembers. Preferably, the crossmember consists of two connecting rods arranged above and below the ejection mechanism. As a result, it is possible to fasten one or more mechanism units to the same crossmember. There are no restrictions with regard to offset body rear walls or various fixtures which impede an upright crossmember. This is, for example, the case when a short drawer is fitted below a sink and the drawers positioned further therebelow have a greater or normal depth. These crossmembers may be current-bearing and thus establish the supply of power and/or the synchronization between two units on a crossmember or serve as a holder for a power cable. For very wide drawers, two or more ejection units can be mounted to ensure parallel extension of the drawers even under one-sided loading.

The invention also relates to a piece of furniture with a movable furniture part which is received on a stationary furniture part, wherein the piece of furniture has a mounting fixture, a device for controlling the movement or a system as described above. It is thus possible to produce, in a piece of furniture, a device for controlling the movement of a furniture part having the above-mentioned advantages.

The term "furniture parts" refers primarily to furniture parts for kitchen and household furniture; however, the term "furniture parts" in the sense of the invention may also extend to drawers, doors and flaps on other fixtures, for example to a drawer on a tool cabinet or trolley.

BRIEF DESCRIPTION OF THE DRAWINGS

Further details and features of the invention will be described in greater detail based on highly schematically illustrated exemplary embodiments with reference to the figures. In some cases, the same reference numerals are used in the figures for corresponding components of different exemplary embodiments.

DETAILED DESCRIPTION OF THE INVENTION

Figure 1:
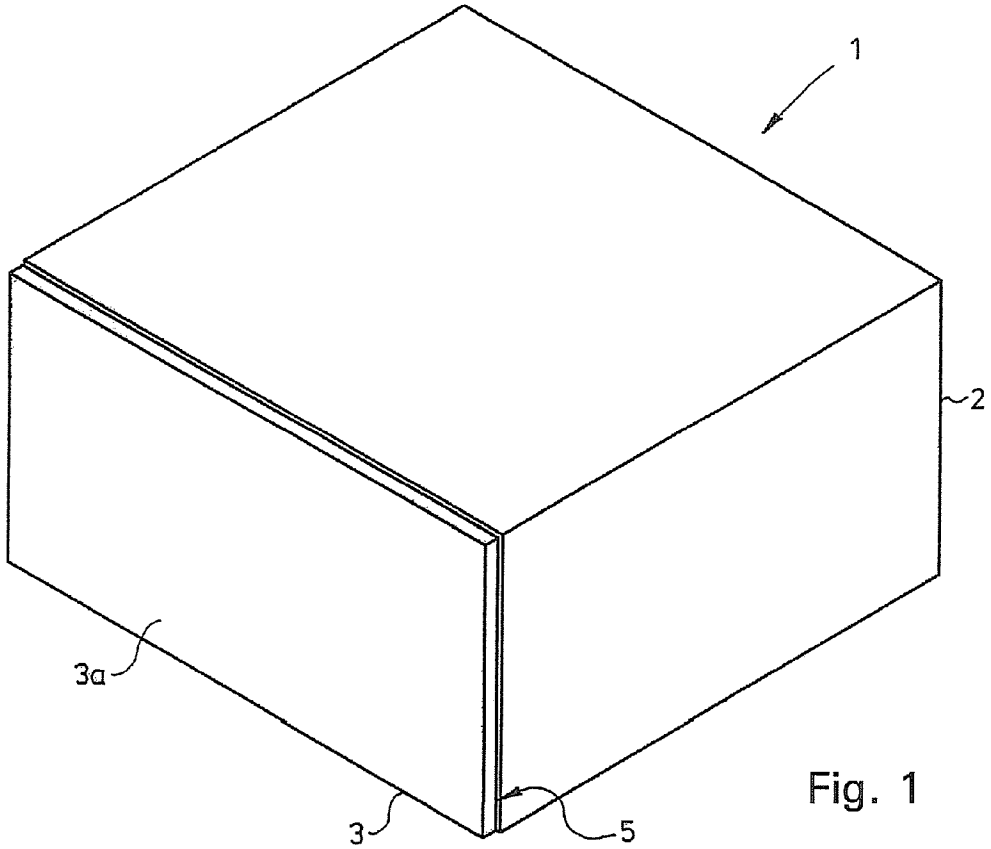
FIG. 1 is a perspective view of a schematically illustrated piece of furniture with a drawer.
Figure 2:
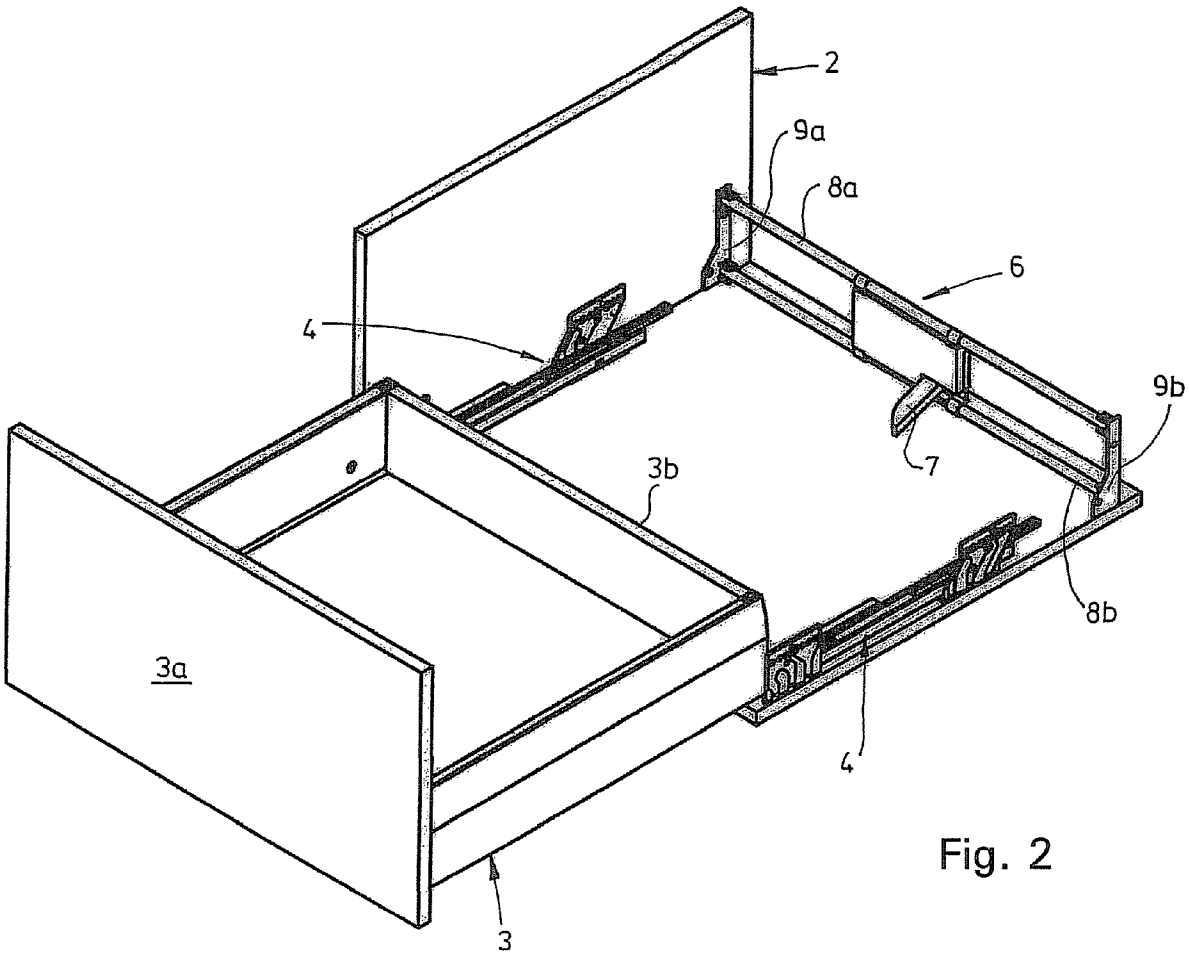
FIG. 2 shows the piece of furniture according to FIG. 1 while omitting individual parts, the drawer being shown opened.

FIGS. 1 and 2 show a piece of furniture 1 with a body 2 and a drawer 3 which is displaceable in the body 2 via a pull-out guide 4. The pull-out guide 4 comprises in particular a full extension which is known per se and has a drawer-side drawer rail, a body-side fixed rail and a central rail which is received so as to be movable therebetween. In FIG. 1, the drawer 3 is in a closing position in which a front gap 5 of, for example, a few millimeters is formed between the body 2 and an inside of a front part 3*a* of the drawer 3. The front part 3*a* does not have a handle in the example shown, although a handle may be present.

The front gap serves primarily to allow, by pressing on the front part 3*a* for an ejecting process, a triggering command in which the drawer 3 can be moved in the direction toward the body 2 over a few millimeters while reducing the front gap 5. A triggered ejecting process is carried out using an ejection device 6 according to the invention. If, in the state shown in FIG. 1, the closed drawer 3 is pressed somewhat, a movement of the drawer can be registered via, for example, corresponding sensors (not shown), as a result of which an ejecting process is triggered by means of the ejection device 6.

FIG. 2 shows the completely opened drawer 3 in the body 2 which is shown without a side wall, rear wall and upper part. An ejection lever 7 of the ejection device 6 is shown in a maximum pivoted position. The ejection lever 7 can be pivoted, for example, relative to the rear wall (not shown) of the furniture body 2 by a maximum pivot angle of approx. 80 to almost 90 angular degrees or more. By pivoting the ejection lever 7, the ejection lever enters into abutment on the outside against a rear wall 3*b* of the drawer 3 and can press the drawer 3 away from a closing position, in particular by a distance of, for example, approx. 30 to 70 mm out of the closed position according to FIG. 1 in the opening direction. For this purpose, the ejection lever 7 is moved in a driven manner from an applied or folded-back position into the pivot position shown in FIG. 2 via a drive unit which is concealed by a housing part. Afterwards, a contact between the rear wall 3*b* and the ejection lever 7 is canceled and the moved drawer 3 can continue to move freely over a certain further distance. Subsequently, preferably while the drawer 3 still moves freely over a certain distance or as soon as the contact between the rear wall 3*b* and the ejection lever 7 is canceled, the ejection lever 7 is pivoted back into the folded-back position, in particular by means of the drive unit, in order to be ready for a subsequent pivoting or ejecting process. In the applied position of the ejection lever 7 (not shown), the longitudinal axis thereof is oriented substantially parallel to the drawer rear wall 3*b* or to crossmembers 8*a*, 8*b*.

The ejection device 6 is releasably clipped-in via the two crossmembers 8*a* and 8*b*. The two crossmembers 8*a*, 8*b* are themselves received in receiving flanges 9*a* and 9*b* which are fastened to the side walls of the furniture body 2.

The ejection device can also be fastened to the drawer 3 and be moved in conjunction therewith; the ejection lever 7 can then enter into contact, at least for ejecting, for example with the rear wall of the body 2. In this case, the rear wall of the drawer 3 can comprise the at least two crossmembers.

The ejection lever 7 is shown in FIG. 2 in its maximum pivoted position, so that the ejection lever may clearly be seen. When the drawer 3 is completely opened, the ejection lever 7 is generally already back in its pivoted-back position or in its rest position.

Figure 3:
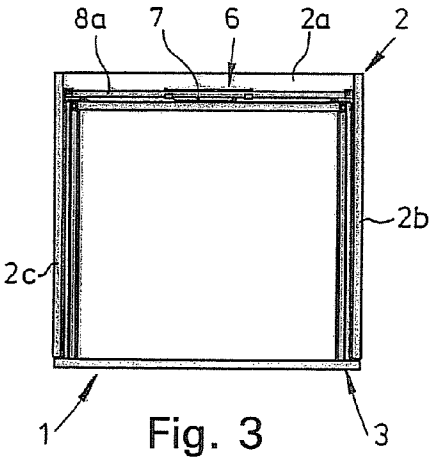

FIGS. 3 to 6 are plan views of a piece of furniture 1, an upper side of the body 2 being omitted. The piece of furniture has an ejection device 6 which is modified compared to the ejection device according to FIG. 2. The furniture body 2 displays a rear wall 2*a*, a right side wall 2*b* and a left side wall 2*c*. Crossmembers 8*a* and 8*b*, which extend between the side walls 2*b* and 2*c* and to which the ejection device 6 is fastened, are also accommodated as shown in FIG. 2. In FIG. 3, in which the drawer 3 is completely closed, the ejection lever 7 is stretched or straight in its shape and in a pivoted-back rest position. The ejection device 6 and the crossmembers 8*a*, 8*b* advantageously require comparatively little overall space, in particular in the depth of the piece of furniture 1.

Figure 5:
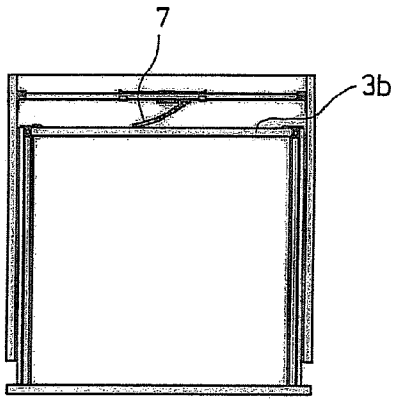
FIG. 3 to FIG. 6 are views from above onto the piece of furniture according to FIG. 1 without an upper part, the drawer being shown in different positions before, during and after an ejecting process.
Figure 4:
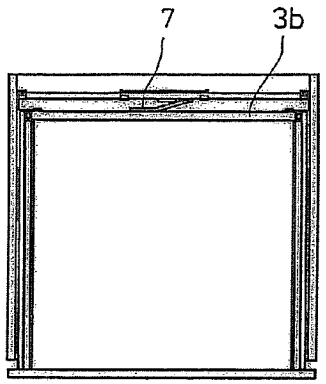

FIGS. 4 and 5 show the ejection lever 7 in a kinked shape or with a kink, wherein a front angled portion of the ejection lever 7 can abut against a rear wall 3*b* of the drawer 3 in a planar (FIG. 4) or point-by-point (FIG. 5) manner. In FIG. 5, the ejection lever 7 is pivoted somewhat further than in FIG. 4, the pivoting movement of the ejection lever 7 being carried out by a drive unit (not shown in greater detail). As a result of the pivoting movement of the ejection lever 7 and the abutment thereof against the rear wall 3*b* of the drawer 3, the drawer 3 is moved from the closed position shown in FIG. 3 over a certain distance in the opening direction. The drawer 3 is moved, as a result of the movement of the ejection lever 7, not quite into the fully opened position according to FIG. 6. On the contrary, the drawer 3 is brought, after the ejecting movement by the ejection lever 7, into a partially opened position from which, for example, a person can open the drawer 3 further or re-close it by hand. The sequence of movement could also be optimized in such a way that the drawer 3 continues up to the complete or to the almost complete opening position simply as a result of the ejecting process.

Figure 6:
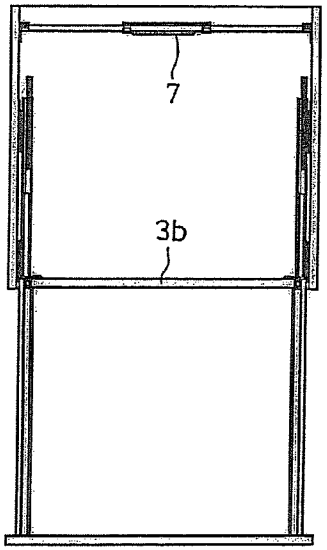

After the ejecting process, the ejection lever 7 is pivoted immediately or shortly thereafter back into its rest position, as illustrated in FIG. 6. As a result of the possibility for articulated kinking of the ejection lever, the ejection lever 7, which is formed in an angular manner during the ejecting process, can be accommodated again, in its rest position according to FIG. 3 or FIG. 6, in the body 2 in a completely stretched or compact manner.

Figure 7:
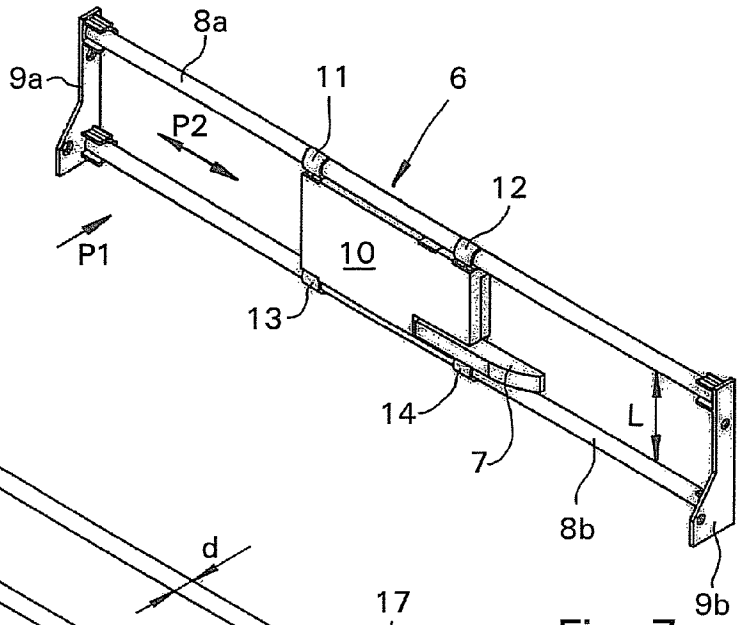
FIG. 7 and FIG. 8 are detailed exploded views of an arrangement according to the invention with an ejection device and a mounting fixture according to FIG. 2.
Figure 8:
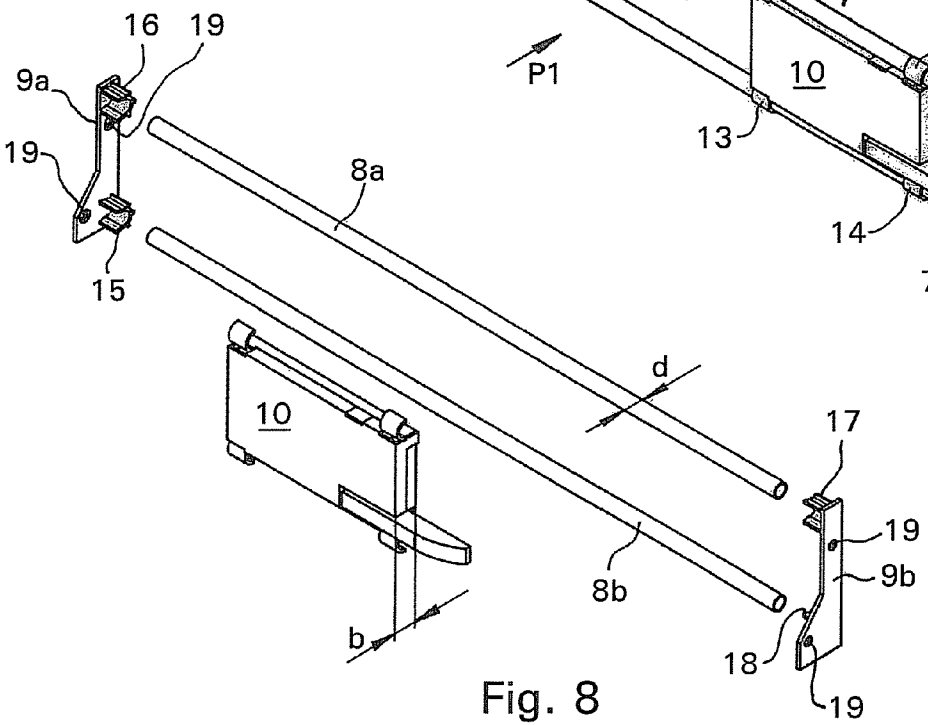

The ejection device 6 according to FIG. 2 with the crossmembers 8*a*, 8*b* and the receiving flanges 9*a*, 9*b* is shown in detail in FIG. 7. FIG. 8 is an exploded view of FIG. 7. The ejection device 6 comprises a basic element 10 with the ejection lever 7 and further components which are concealed by housing portions of the ejection device 6. Four attachment jaws 11, 12, 13 and 14, which are open in one direction, are embodied at the longer narrow sides of the basic element 10. The two legs of the U-shaped attachment jaws can be bent up somewhat in a resilient manner and are adapted to the crossmembers 8*a* and 8*b*, which are embodied as round profiles, in such a way that the basic element 10 can be placed onto the crossmembers 8*a* and 8*b* via the attachment jaws 11 to 14 in the direction of the arrow P1. The attachment jaws 11 to 14 can be used to releasably connect the basic element 10 at different attachment positions in the longitudinal direction of the crossmembers 8*a*, 8*b*. Care must merely be taken to ensure that the ejection lever 7 does not collide with the receiving flange 9*b* in the pivoted-back position according to FIG. 7. Once the basic element 10 has been placed onto the crossmembers 8*a*, 8*b* via the attachment jaws 11 to 14, as FIG. 7 shows, the basic element 10 can be finely adjusted along the crossmembers 8*a*, 8*b* as a result of the fact that the basic element 10, which is placed onto the crossmembers 8*a*, 8*b*, can be displaced along the crossmembers in the direction of the double-headed arrow P2. However, the clamping force with which the attachment jaws 11 to 14 act on the crossmembers 8*a*, 8*b* can also be so great that displacement of the basic element 10 in the direction of arrow P2 is not possible or is possible only on application of excessive force. For example, there may be present on the attachment jaws 11 to 14 portions which are made of soft material, enter into abutting contact with the crossmembers 8*a*, 8*b* and do not allow or greatly impede displacement of the basic element 10 in the direction P2 via frictional engagement with the crossmembers 8*a*, 8*b*.

The arrangement according to FIG. 7 or FIG. 8 shows a possibility, which is ideal for mounting reasons, for attaching, in particular on the front side, the basic element 10 to the crossmembers 8*a*, 8*b*.

The exploded view according to FIG. 8 clearly shows the dimensions of the parts according to FIG. 7 or the possibility for assembly from the individual elements. Accordingly, the receiving flange 9*a* has two receiving clamps 15, 16 and the receiving flange 9*b* has two receiving clamps 17, 18. The receiving clamps 15 to 18 are slightly elastically deformable to the extent that the ends of the rigid crossmembers 8*a* and 8*b* can be clipped into the receiving clamps 15 to 18 and be releasably attached thereto.

In addition, the receiving flanges 9*a*, 9*b* each have two holes 19 in order to fasten the receiving flanges to furniture portions, for example using a screw.

The receiving flanges 9*a*, 9*b* are, in the example according to FIG. 2 shown, screwed onto body side walls 2*b* and 2*c* respectively (side wall 2*c* is not shown in FIG. 2). In principle, the receiving flanges 9*a*, 9*b* can also be fastened to the rear wall 3*b* of the drawer 3 in such a way that the crossmembers 8*a*, 8*b* can also be received therein and the basic element 10 can be fastened thereto. In this case, the ejection lever presses during the ejecting process, for example, against a rear wall of a body.

FIG. 7 also shows a clearance L between the crossmembers 8*a*, 8*b* which are embodied as round profiles. The clearance L is in a material-free region between the crossmembers 8*a*, 8*b* extending set apart from each other that is continuous in its configuration in the exemplary embodiment shown. In principle, a spacer may also be introduced between the crossmembers 8*a*, 8*b*.

The arrangement according to FIG. 7 or FIG. 8 allows, in particular, the crossmembers 8*a*, 8*b* and the ejection device 6, or the basic element 10 of the ejection device 5, to be clipped-in on the receiving flanges 9*a*, 9*b* in the direction P1, in particular with few manual operations.

It is also possible for more than two receiving clamps to be present on each of the receiving flanges, for example on the receiving flanges 9*a* and 9*b*. This allows, for example, more than two crossmembers to be clipped-in or, alternatively, different distances may be produced between two crossmembers. This may be advantageous, for example, when different clearances L are necessary for accommodating various devices for controlling the movement or ejection devices.

The crossmembers 8*a*, 8*b* are formed, in the example shown, in particular as profiles which are cut to length and are formed from profile parts which are used as standard in the construction of furniture. For example, hollow round profiles made of light metal may advantageously be used here. However, other materials, such as for example plastics material or else solid materials, are also possible. The profile shape of crossmembers corresponding to the crossmembers 8*a*, 8*b* may also be different. Possible examples include all conceivable profiled solid, hollow or T or double T-shaped profiles. The cross-sectional shape of the crossmembers may, for example, also be rectangular or square or polygonal in their embodiment. Moreover, U or double U-shaped profiles are also possible.

The thickness or width b of the narrow side of the basic element 10 is equal or roughly equal to the diameter d of the crossmembers 8*a*, 8*b*, as a result of which, in the attached state of the ejection device 6 as shown in FIG. 7, the basic element 10 advantageously does not protrude, or protrudes only slightly, beyond the crossmembers 8*a*, 8*b* in the direction P1.

Figure 9:
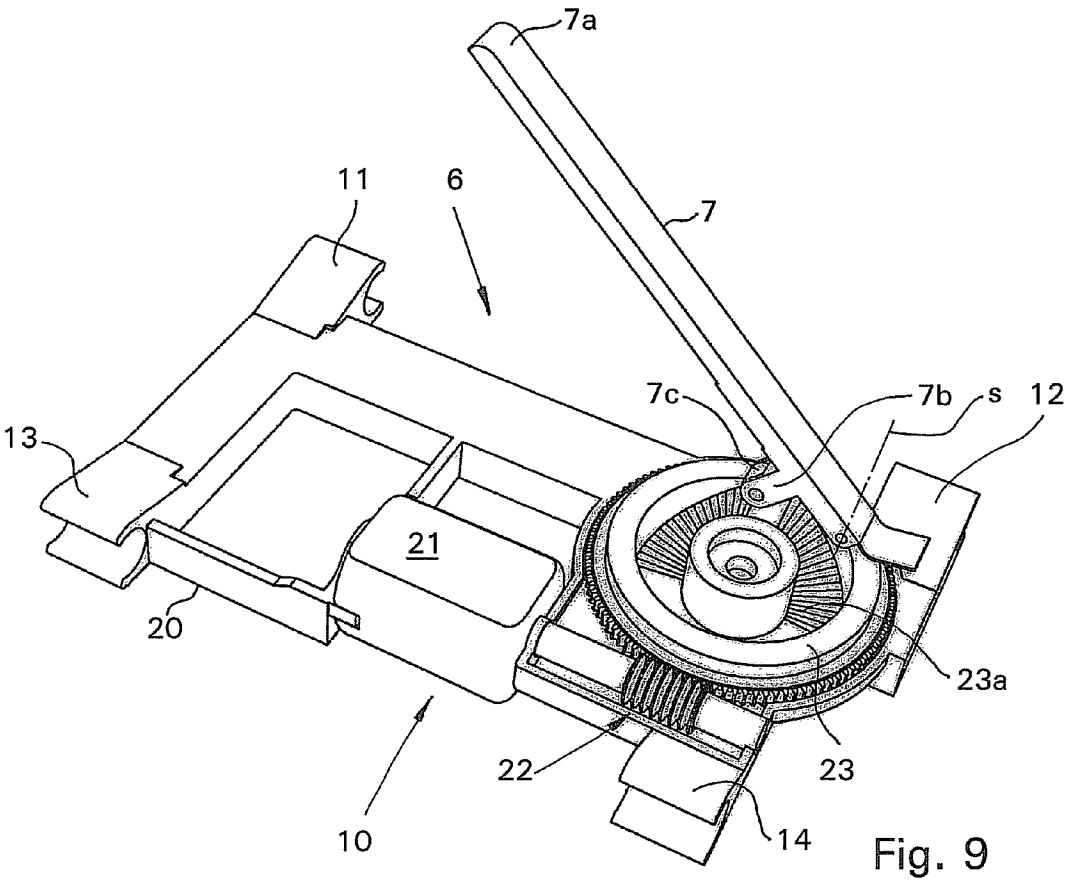
FIG. 9 shows an alternative ejection device according to the invention.

FIG. 9 shows an alternative arrangement of an ejection device 6 with a basic element 10 comprising a frame 20. In addition to the ejection lever 7 with the abutment side 7*a* thereof, an electric motor 21, a gear mechanism 22, a control wheel 23 and attachment jaws 11 to 14 are received on the frame 20. The attachment jaws 11 to 14 are, in the direction of a narrow side of the basic element 10, in each case configured so as to be open for clipping-in on round profiles or on the crossmembers 8*a*, 8*b* according to FIG. 2 or 7. However, the attachment of the basic element 10 according to FIG. 9 between the crossmembers 8*a*, 8*b* according to FIG. 2 or 7 is somewhat less convenient than the attachment of the basic element 10 according to FIG. 7.

FIG. 9 also shows a rotary drive with an electric motor 21 which drives a control wheel 23, which has outer teeth, via a gear mechanism 22. A rotating guide track 23*a*, via which the driven pivoting movement of the ejection lever 7 about the pivot axis S can be carried out, is also present on the control wheel 23. For this purpose, the ejection lever 7 has a supporting foot 7*b* with a roll 7*c*. During the driven rotation of the control wheel 23, the ejection lever 7 is pivoted outward or returned to a pivoted-back position via the supporting of the roll 7*c* on the guide track 23*a*.

Figure 10:
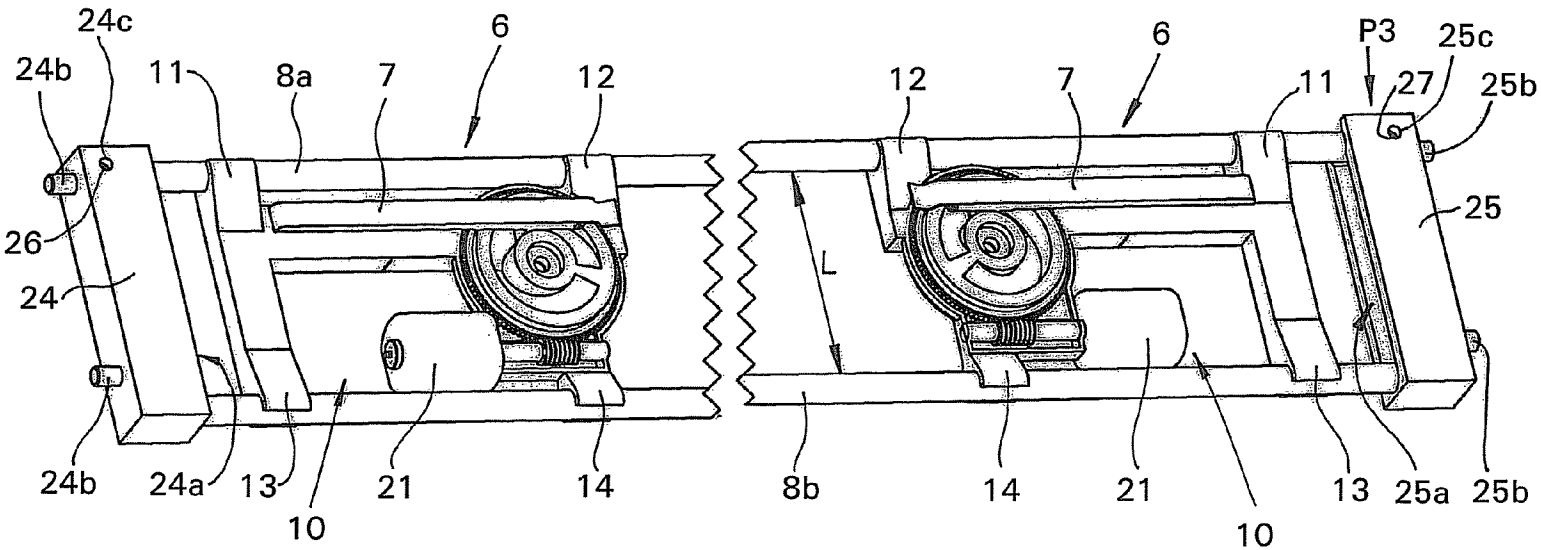
FIG. 10 shows a further arrangement according to the invention with two ejection devices and a mounting fixture.

FIG. 10 shows an alternative arrangement according to the invention for ejecting, for example, relatively wide drawers. Grooves 24*a*, 25*a*, which, for inserting the ends of the crossmembers 8*a*, 8*b*, are configured at the top so as to be open on one side, are present in two receiving flanges 24, 25. As a result, the ends of the crossmembers 8*a*, 8*b* can be, for example, inserted in the direction of arrow P3 into the receiving flanges 24, 25 and be fixed therein, for example with a clamping fit. The crossmembers 8*a*, 8*b*, which extend substantially parallel to each other in the clearance L, are shown interrupted in FIG. 10, a covering cap of the housing of the two ejection devices 6 not being shown in each case either. The ejection devices 6 each comprise a separate basic element 10 with in each case an ejection lever 7 which is driven via a separate electric motor 21. Movement is transmitted from the electric motor 21 to the ejection lever 7 in accordance with the arrangement shown in FIG. 9, the two ejection devices 6 being configured so as to be mirror-inverted relative to each other in FIG. 10. The two ejection levers 7 in FIG. 10 therefore move, during the pivoting from the illustrated rest position during the driven movement, in opposite pivoting directions.

Each receiving flange 24, 25 is respectively provided on an outside, which is opposite the receiving groove 24*a* or 25*a*, with two peg elements 24*b*, 25*b*. The peg elements 24*b*, 25*b* serve to fix the receiving flanges 24, 25 to a corresponding furniture portion with two holes which match the peg elements 24*b*, 25*b* and in which the peg elements 24*b*, 25*b* can be fixed so as to be, for example, adhesively bonded-in or pressed-in. However, in principle, the receiving flanges 24, 25 can also be fastened in a different manner, for example by screwing onto a furniture part portion. In particular, the receiving flanges 24, 25 are configured as plastics material parts.

Respective holes 24*c*, 25*c* with an internal thread and a set screw 26, 27 pertaining thereto are formed in the receiving flanges 24, 25. The set screws 26, 27, which, as a result of being screwed-in, act on the two end portions of the crossmember 8*a*, can be used to adjust the upper crossmember 8*a*, which is closer to the ejection levers 7, toward the front or toward the rear. The lower crossmember 8*b* remains, on the other hand, fixed in the receiving groove 24*a*, 25*a*. The different setting of the crossmember 8*a* allows, for example, a front gap to be set when the drawer 3 is closed, the rear wall of said drawer abutting the folded-back ejection lever 7 as shown, for example, in FIG. 10. The comparatively minor rotation of the upper crossmember 8*a* relative to the lower crossmember 8*b* has no influence on the action of the ejection device 6. The two basic elements 10 are each provided with attachment jaws 11 to 14 in accordance with the arrangement of the basic element 10 from the FIG. 9.

In principle, the basic element 10 of the ejection device 6 can, in accordance with the invention, also be attached indirectly to the crossmembers 8*a*, 8*b*, for example be releasably attached, for example clipped-in, to an intermediate part, the intermediate part itself being, in particular, placed onto the crossmembers 8*a*, 8*b* or otherwise releasably attached thereto.

Figure 11:
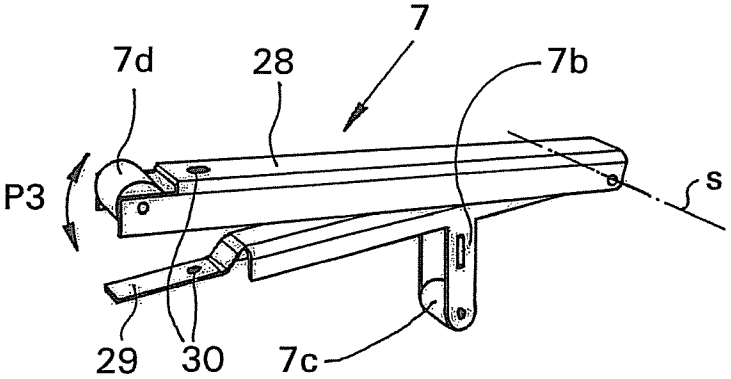
FIG. 11 shows a variant of a two-part ejection lever.

FIG. 11 shows a two-part ejection lever 7 with an upper part 28 and a base part 29, the two parts 28, 29 being adjustable relative to each other, for example the upper part 28 about the pivot axis S of the ejection lever 7 in the direction of arrow P3. The upper part 28 carries a contact roll 7*d* for contact with a mating portion during the ejecting process and the base part 29 has a supporting foot 7*b* with a roll 7*c* for supporting on a guide track of a control wheel (not shown). Between two holes 30 in the upper part 28 and the base part 29, in the base part 29 the distance between the two lever parts 28 and 29 can be adjusted, for example using a helical spring (not shown) or a screw (not shown), for example in order to set a closing gap in the closed movable furniture part.

LIST OF REFERENCE NUMERALS

1 Piece of furniture
2 Body
2*a* Rear wall
2*b* Side wall
2*c* Side wall
3 Drawer
3*a* Front part
3*b* Rear wall
4 Pull-out guide
5 Front gap
6 Ejection device
7 Ejection lever
7*a* Abutment side
7*b* Supporting foot
7*c* Roll
7*d* Contact roll
8*a* Crossmember
8*b* Crossmember
9*b* Receiving flange
10 Basic element
11 Attachment jaw
12 Attachment jaw
13 Attachment jaw

14 Attachment jaw
15 Receiving clamp
16 Receiving clamp
17 Receiving clamp
18 Receiving clamp
19 Hole
20 Frame
21 Electric motor
22 Gear mechanism
23 Control wheel
23*a* Guide track
24 Receiving flange
24*a* Receiving groove
24*b* Peg element
24*c* Hole
25 Receiving flange
25*a* Receiving groove
25*b* Peg element
25*c* Hole
26 Set screw
27 Set screw
28 Upper part
29 Base part
30 Hole
31 Electrical connection

I claim:

1. A mounting fixture for attaching at least one device for controlling the movement of a furniture part which is received on a stationary furniture part so as to be movable in a driven manner, the mounting fixture having at least two physically separate elongate profiles which extend separately from each other with a clearance therebetween defining a material free space, and the at least one device for controlling the movement is attached in said clearance.

2. The mounting fixture as claimed in claim 1, wherein the at least two profiles are embodied such that the device for controlling the movement can be fixed to the profiles at one of a plurality of possible points.

3. The mounting fixture as claimed in claim 1, wherein the at least two profiles extend substantially parallel and are received at their ends in flange parts.

4. The mounting fixture as claimed in claim 3, wherein the flange parts are arranged opposing each other on furniture portions of a furniture part in which the ends of the profiles are fixed.

5. The mounting fixture as claimed in claim 3, wherein the flange parts consist of flat wall portions on which receptacles are embodied for releasably attaching the ends of the profiles.

6. The mounting fixture as claimed in claim 1, wherein a longitudinal axis of the at least two profiles, which jointly allow the attachment of the device for controlling the movement, extend one of substantially parallel horizontally and substantially parallel vertically.

7. The mounting fixture as claimed in claim 1, wherein the at least two profiles are embodied to allow an adjustment of a closing gap.

8. The mounting fixture as claimed in claim 1, wherein the device for controlling the movement comprises an ejection lever that is embodied to allow an adjustment of a closing gap.

9. A piece of furniture with a movable furniture part which is received on a stationary furniture part, wherein the piece of furniture has a mounting fixture as claimed in claim 1.

10. A device for controlling the movement of a furniture part which is received on a stationary furniture pail so as to be movable in a driven manner, wherein the device for controlling the movement has an attachment mechanism for attaching to a mounting fixture having at least two physically separate elongate profiles which extend separately from each other with a clearance therebetween defining a material free space, wherein the device for controlling the movement is attached in said clearance.

11. The device as claimed in claim 10, wherein the attachment mechanism is configured such that the device for controlling the movement is clipped onto the mounting fixture.

12. The device as claimed in claim 10, wherein the device for controlling the movement comprises a basic element which can be attached to the mounting fixture via an attachment mechanism that is present thereon on an edge side.

13. The device as claimed in claim 12, wherein the attachment mechanism has portions which hinder displacement of the basic element, which is clipped onto the at least two profiles, along the profiles.

14. A system for controlling the movement of a furniture part comprising the device of claim 10.

15. A piece of furniture with a movable furniture part which is received on a stationary furniture part, wherein the piece of furniture has a device as claimed in claim 10.

16. A system for controlling the movement of a furniture part comprising a mounting fixture having at least two physically separate elongate profiles which extend separately from each other with a clearance therebetween defining a material free space, and a device for controlling the movement of the furniture part attached in said clearance.

17. The system as claimed in claimed 16, wherein the overall size of a basic element of the device for controlling the movement is adapted such that the basic element extends, when attached to the mounting fixture, substantially between the at least two profiles with a width substantially equal to a diameter of the at least two elongated profiles of the mounting fixture.

18. A piece of furniture with a movable furniture part which is received on a stationary furniture part, wherein the piece of furniture has a system as claimed in claim 16.

* * * * *